US008281870B2

(12) United States Patent
Chang

(10) Patent No.: US 8,281,870 B2
(45) Date of Patent: Oct. 9, 2012

(54) ATOMIZED FIRE APPARATUS THAT IS MOVED AND OPERATED EASILY AND QUICKLY

(75) Inventor: Yuan-Huan Chang, Changhua Hsien (TW)

(73) Assignee: Yue San Enterprise Co., Ltd., Changhua County (TW)

( * ) Notice: Subject to any disclaimer, the term of this patent is extended or adjusted under 35 U.S.C. 154(b) by 193 days.

(21) Appl. No.: 12/846,872

(22) Filed: Jul. 30, 2010

(65) Prior Publication Data

US 2011/0303424 A1 Dec. 15, 2011

(30) Foreign Application Priority Data

Jun. 11, 2010 (TW) ..... 99211282 U

(51) Int. Cl.
*A62C 25/00* (2006.01)

(52) U.S. Cl. ..... 169/52; 169/13; 239/332; 239/526

(58) Field of Classification Search ..... 239/146, 239/148, 303–305, 329, 331, 332, 526, 67; 169/13, 51, 52, 24, 25
See application file for complete search history.

(56) References Cited

U.S. PATENT DOCUMENTS 4,967,960 A * 11/1990 Futrell ..... 239/148

* cited by examiner

*Primary Examiner* — Christopher Kim
(74) *Attorney, Agent, or Firm* — Chi IP Law Firm

(57) ABSTRACT

A fire apparatus includes a housing, a water tank mounted in the housing, a support unit mounted on the housing, a spray gun mounted on and supported by the support unit, a hose having a first end connected with the water tank and a second end connected with the spray gun, a drive motor mounted in the housing and electrically connected with the spray gun to pressurize the spray gun, and an electric storage unit mounted in the housing and electrically connected with the drive motor to supply an electric power to the drive motor. Thus, the spray gun injects atomized water outward to extinguish the fires easily and quickly.

17 Claims, 6 Drawing Sheets

ATOMIZED FIRE APPARATUS THAT IS MOVED AND OPERATED EASILY AND QUICKLY

BACKGROUND OF THE INVENTION

1. Field of the Invention

The present invention relates to a fire system and, more particularly, to a fire apparatus that injects atomized water or bubbles to extinguish fires in an atomizing manner.

2. Description of the Related Art

A conventional fire apparatus is mounted on the ceiling and comprises a smoke detector and a water sprinkler. When the smoke detector detects that the fires happen, the water sprinkler is activated by the smoke detector to sprinkle water outward automatically so as to extinguish the fires. However, the conventional fire apparatus fails when the smoke detector is inoperative, thereby causing danger to the user. In addition, the water sprinkler sprays water to the whole house so that the water will wet the electric appliances in the house, thereby easily causing an electric shock to the user. A conventional fire extinguisher can also to be used to extinguish the fires. However, the conventional fire extinguisher has a smaller volume and cannot extinguish the fires successively.

BRIEF SUMMARY OF THE INVENTION

In accordance with the present invention, there is provided a fire apparatus, comprising a housing, a water tank mounted in the housing, a support unit mounted on the housing, a spray gun mounted on and supported by the support unit, a hose having a first end connected with the water tank and a second end connected with the spray gun, a drive motor mounted in the housing and electrically connected with the spray gun to pressurize the spray gun, and an electric storage unit mounted in the housing and electrically connected with the drive motor to supply an electric power to the drive motor.

The support unit is provided with a microswitch electrically connected with the drive motor to control operation of the drive motor. The spray gun presses the microswitch of the support unit at a normal state so that the drive motor stops operating at the normal state. The spray gun is provided with a trigger and a spraying nozzle. The fire apparatus further comprises an illuminating unit mounted on the housing and electrically connected with the electric storage unit. The illuminating unit is mounted on the top of the housing and is located outside of the housing. The illuminating unit is rotatable through three hundred and sixty degrees)(360°). The fire apparatus further comprises a bubble tank mounted in the housing, and the first end of the hose is selectively connected with the bubble tank. The spray gun is removably mounted on the support unit. The spray gun is detachable from the microswitch of the support unit when the spray gun is removable from the support unit so that the microswitch of the support unit is released to conduct and start the drive motor which delivers the water in the water tank through the hose into the spray gun and pressurizes the water in the spray gun to form a high pressure water. When the spray gun presses the microswitch of the support unit, the drive motor stops operating and releases the pressure in the hose. The water tank is externally connected with an independent water source that is located outside of the housing. The fire apparatus further comprises an independent power supply electrically connected with the electric storage unit to charge the electric storage unit.

The primary objective of the present invention is to provide an atomized fire apparatus that is moved and operated easily and quickly.

According to the primary advantage of the present invention, the spray gun injects atomized water outward so as to extinguish the fires easily and quickly.

According to another advantage of the present invention, the microswitch of the support unit can control operation of the drive motor to release the pressure in the hose after the fires are extinguished so as to prevent the hose from leaking due to an excessive pressure.

According to a further advantage of the present invention, the spray gun is movable to extinguish the fires at the determined location without wetting the other place in the house so as to prevent from causing damage to the electric appliances in the house.

According to a further advantage of the present invention, the electric storage unit is used to supply the electric power so that the spray gun can be operated normally when the external power supply fails.

According to a further advantage of the present invention, the illuminating unit is rotatable freely so as to provide an illuminating effect to the user.

According to a further advantage of the present invention, the water tank is externally connected with an independent water source to supply water to the spray gun so that the spray gun can inject atomized water successively.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
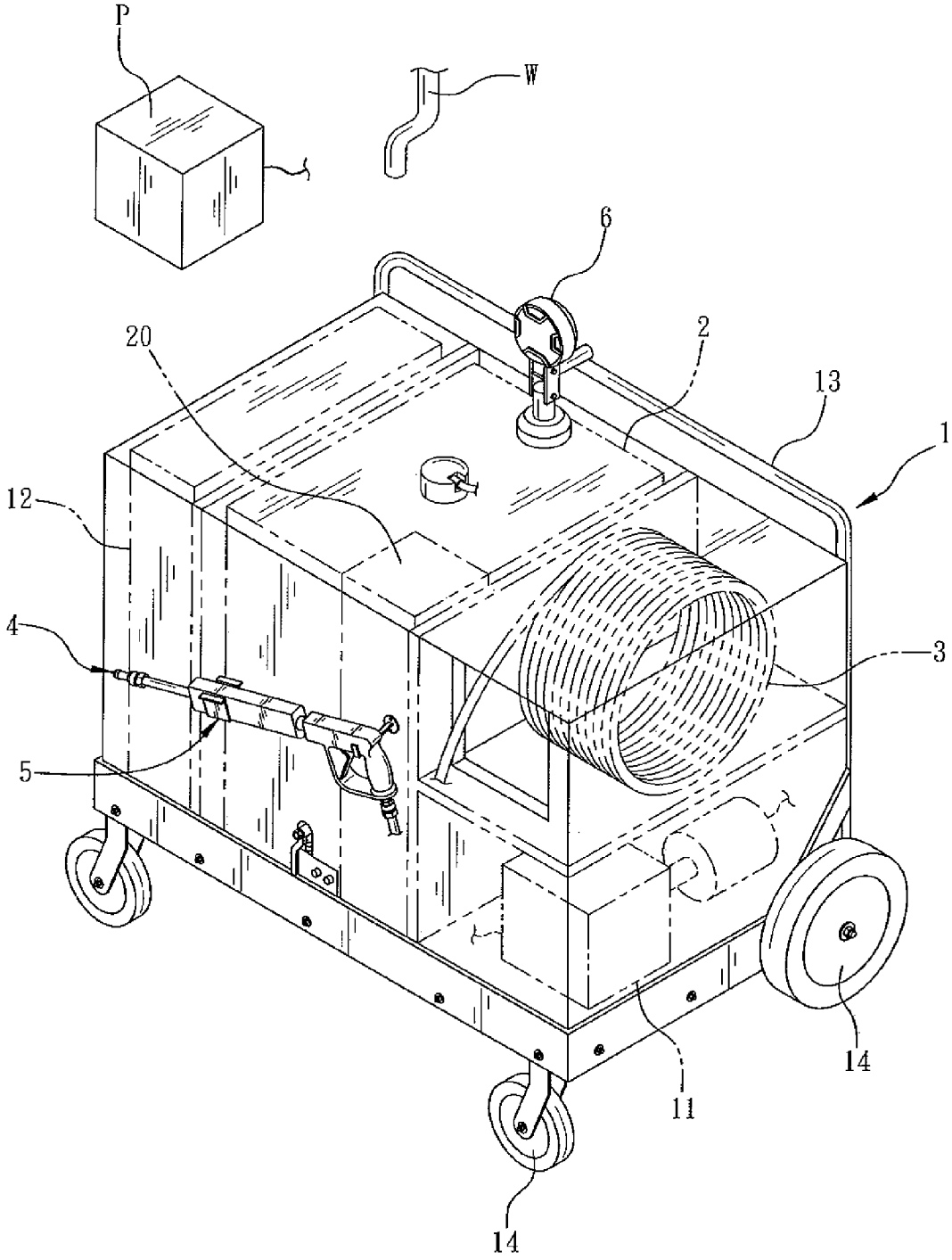
FIG. 1 is a perspective view of a fire apparatus in accordance with the preferred embodiment of the present invention.
Figure 2:
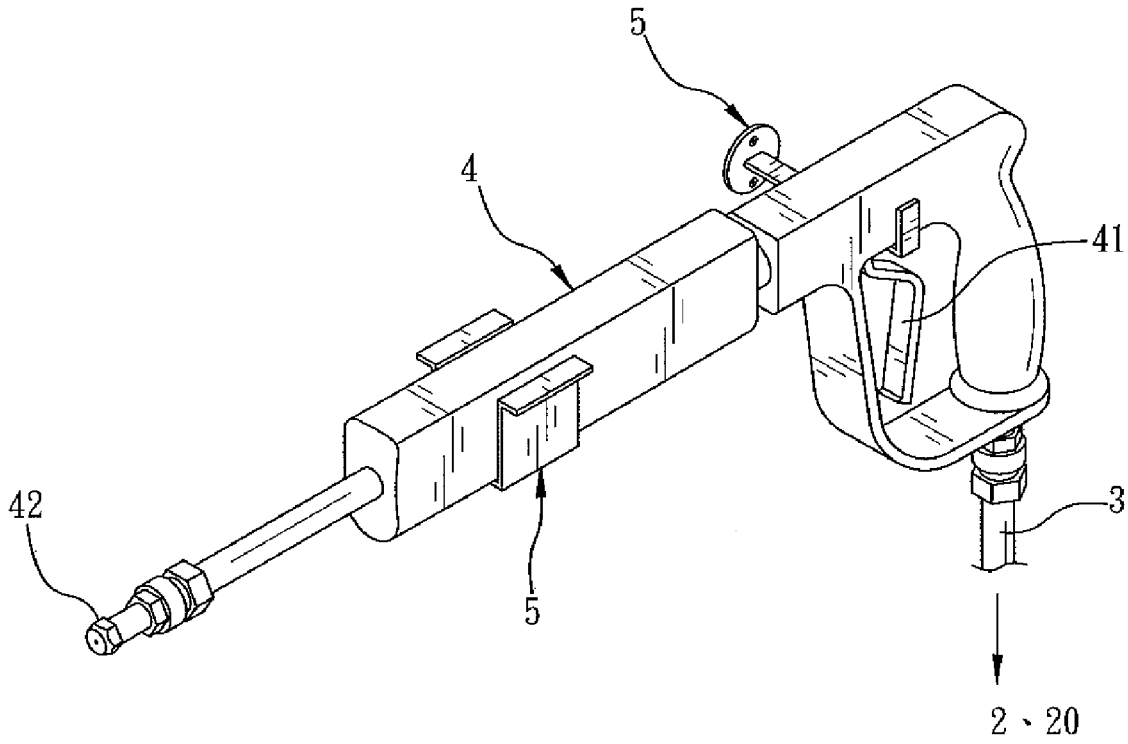
FIG. 2 is a partially perspective view of the fire apparatus as shown in FIG. 1.
Figure 3:
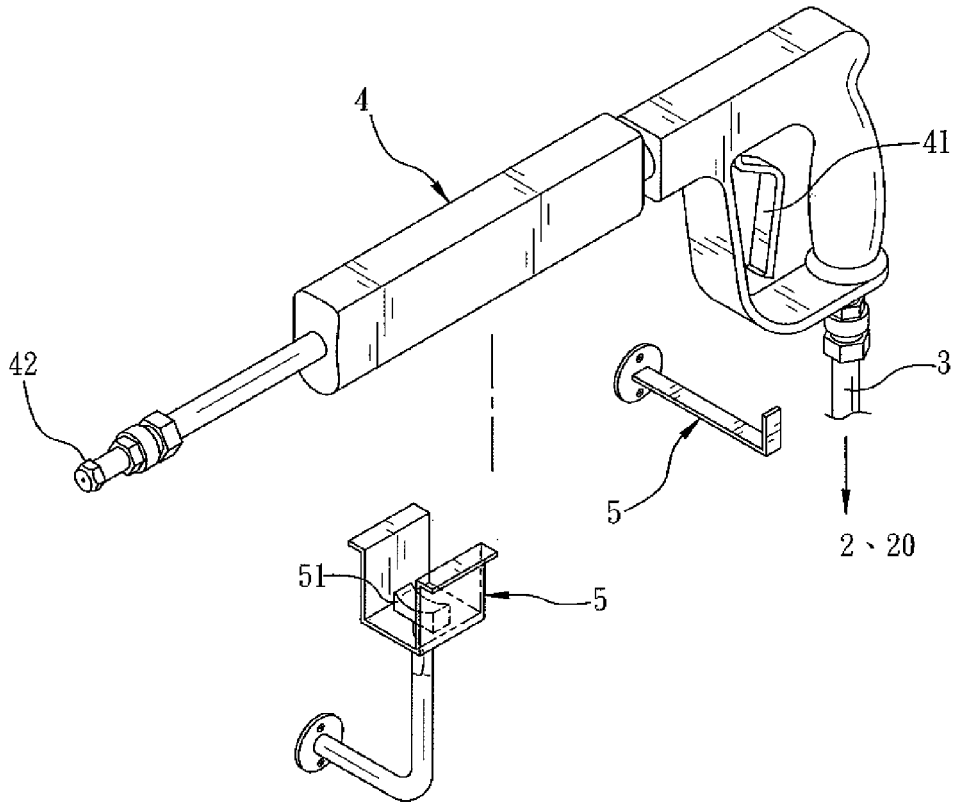
FIG. 3 is an exploded perspective view of the fire apparatus as shown in FIG. 2.

Referring to the drawings and initially to FIGS. 1-3, a fire apparatus in accordance with the preferred embodiment of the present invention comprises a housing 1, a water tank 2 mounted in the housing 1 and containing water therein, a support unit 5 mounted on the housing 1, a spray gun 4 mounted on and supported by the support unit 5, a hose 33 having a first end connected with the water tank 2 and a second end connected with the spray gun 4, a drive motor 11 mounted in the housing 1 and electrically connected with the spray gun 4 to pressurize the spray gun 4, an electric storage unit 12 mounted in the housing 1 and electrically connected with the drive motor 11 to supply an electric power to the drive motor 11, an illuminating unit 6 mounted on the housing 1 and electrically connected with the electric storage unit 12, a substantially inverted U-shaped support rail 13 mounted on a top of the housing 1, and a plurality of castors 14 mounted on a bottom of the housing 1.

The water tank 2 is externally connected with an independent water source "W" that is located outside of the housing 1. The hose 33 is mounted in the housing 1 and is extendable outward from the housing 1. The hose 33 is made of a material (such as stainless steel) that can withstand a weight of at least sixty (60) kilograms. The hose 33 has a length of about ten to thirty (10-30) meters. The fire apparatus further comprises a bubble tank 20 mounted in the housing 1 and containing bubbles therein, and the first end of the hose 33 is selectively connected with the bubble tank 20.

The drive motor 11 is connected with the water tank 2 to pressurize the water tank 2 and the hose 33 and to deliver the water in the water tank 2 through the hose 33 into the spray gun 4. The drive motor 11 is selectively connected with the bubble tank 20 to pressurize the bubble tank 20 and the hose 33 and to deliver the water in the bubble tank 20 through the hose 33 into the spray gun 4.

The support unit 5 is located outside of the housing 1. The support unit 5 is provided with a microswitch 51 electrically connected with the drive motor 11 to control operation of the drive motor 11.

The spray gun 4 is provided with a trigger 41 and a spraying nozzle 42. The liquid contained in the spray gun 4 is pressurized by the drive motor 11 to form a high pressure liquid that is injected outward from the spraying nozzle 42 in an atomized manner. The spray gun 4 is removably mounted on the support unit 5. The spray gun 4 presses the microswitch 51 of the support unit 5 at a normal state so that the drive motor 11 stops operating at the normal state. The spray gun 4 is detached from the microswitch 51 of the support unit 5 when the spray gun 4 is removed from the support unit 5 so that the microswitch 51 of the support unit 5 is released to conduct and start the drive motor 11 which delivers the water in the water tank 2 through the hose 33 into the spray gun 4 and pressurizes the water in the spray gun 4 to form a high pressure water. In such a manner, when the trigger 41 of the spray gun 4 is pressed, the high pressure water in the spray gun 4 is injected and sprayed outward from the spraying nozzle 42 of the spray gun 4 in an atomized manner. On the contrary, when the trigger 41 of the spray gun 4 is released, the spray gun 4 stops spraying the atomized water, and when the spray gun 4 presses the microswitch 51 of the support unit 5, the drive motor 11 stops operating and releases the pressure in the hose 33.

The fire apparatus further comprises an independent power supply "P" electrically connected with the electric storage unit 12 to charge the electric storage unit 12. The independent power supply "P" is located outside of the housing 1. The electric storage unit 12 is a direct-current secondary battery that can be charged by the independent power supply "P" and can supply the electric power to the drive motor 11 during a period of time exceeding fifteen (15) minutes. The illuminating unit 6 is mounted on the top of the housing 1 and is located outside of the housing 1. The illuminating unit 6 is rotatable through three hundred and sixty degrees)(360°) to provide an illuminating effect to the user.

Figure 4:
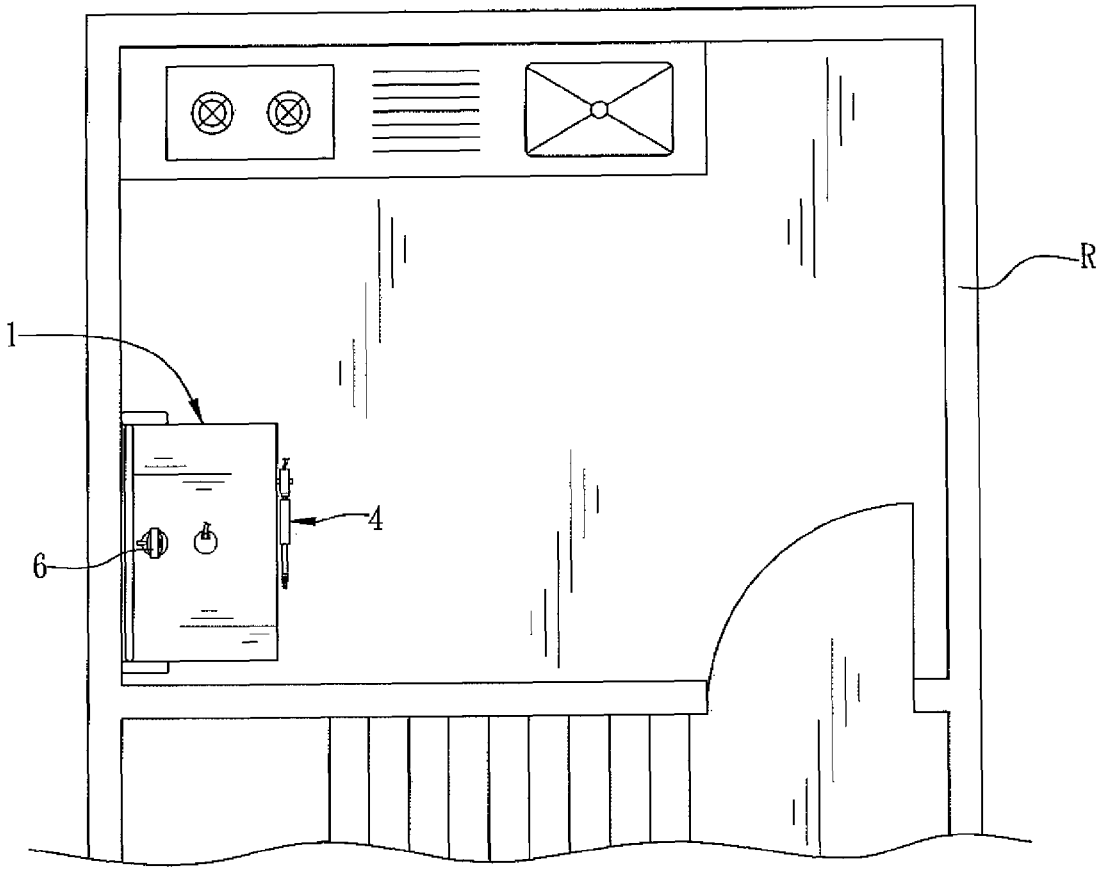
FIG. 4 is a top view of the fire apparatus for a restaurant kitchen in accordance with the preferred embodiment of the present invention.
Figure 5:
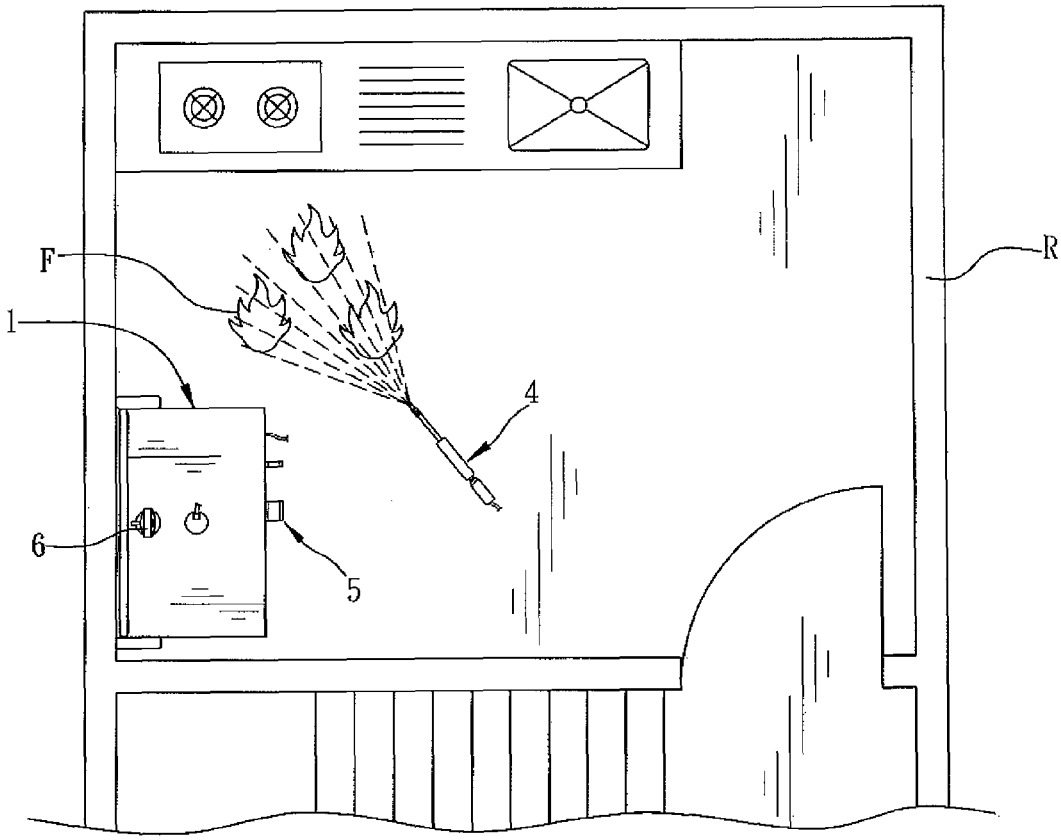
FIG. 5 is a schematic operational view of the fire apparatus as shown in FIG. 4 in use.

In operation, referring to FIGS. 4 and 5 with reference to FIGS. 1-3, the housing 1 is placed on a corner of a restaurant kitchen "R". In such a manner, when fires happen at a determined location "F" in the restaurant kitchen "R", the spray gun 4 is removed from the support unit 5 so that the microswitch 51 of the support unit 5 is released to conduct and start the drive motor 11 which delivers the water in the water tank 2 through the hose 33 into the spray gun 4 and pressurizes the water in the spray gun 4 to form a high pressure water. Thus, when the trigger 41 of the spray gun 4 is pressed, the high pressure water in the spray gun 4 is injected and sprayed outward from the spraying nozzle 42 of the spray gun 4 in an atomized manner so as to extinguish the fires at the determined location "F". At this time, the atomized water injected from the spray gun 4 has smaller size. Thus, when the atomized water touches the fires, the atomized water is heated and vaporized into vapors so that the whole volume of the vapors is expanded largely to isolate the oxygen in the air from the fires so as to extinguish the fires easily and quickly. In addition, the atomized water will not conduct the electricity to prevent from causing an electric shock to the user. Further, the spray gun 4 is movable to extinguish the fires at the determined location "F" only without wetting the other place in the house to prevent from causing damage to the electric appliances in the house.

After the fires are extinguished, the trigger 41 of the spray gun 4 is released so that the spray gun 4 stops spraying the atomized water. Then, the spray gun 4 is placed on the support unit 5 and presses the microswitch 51 of the support unit 5 so that the drive motor 11 stops operating, and the pressure in the hose 33 is released to prevent the hose 33 from leaking due to an excessive pressure.

Figure 6:
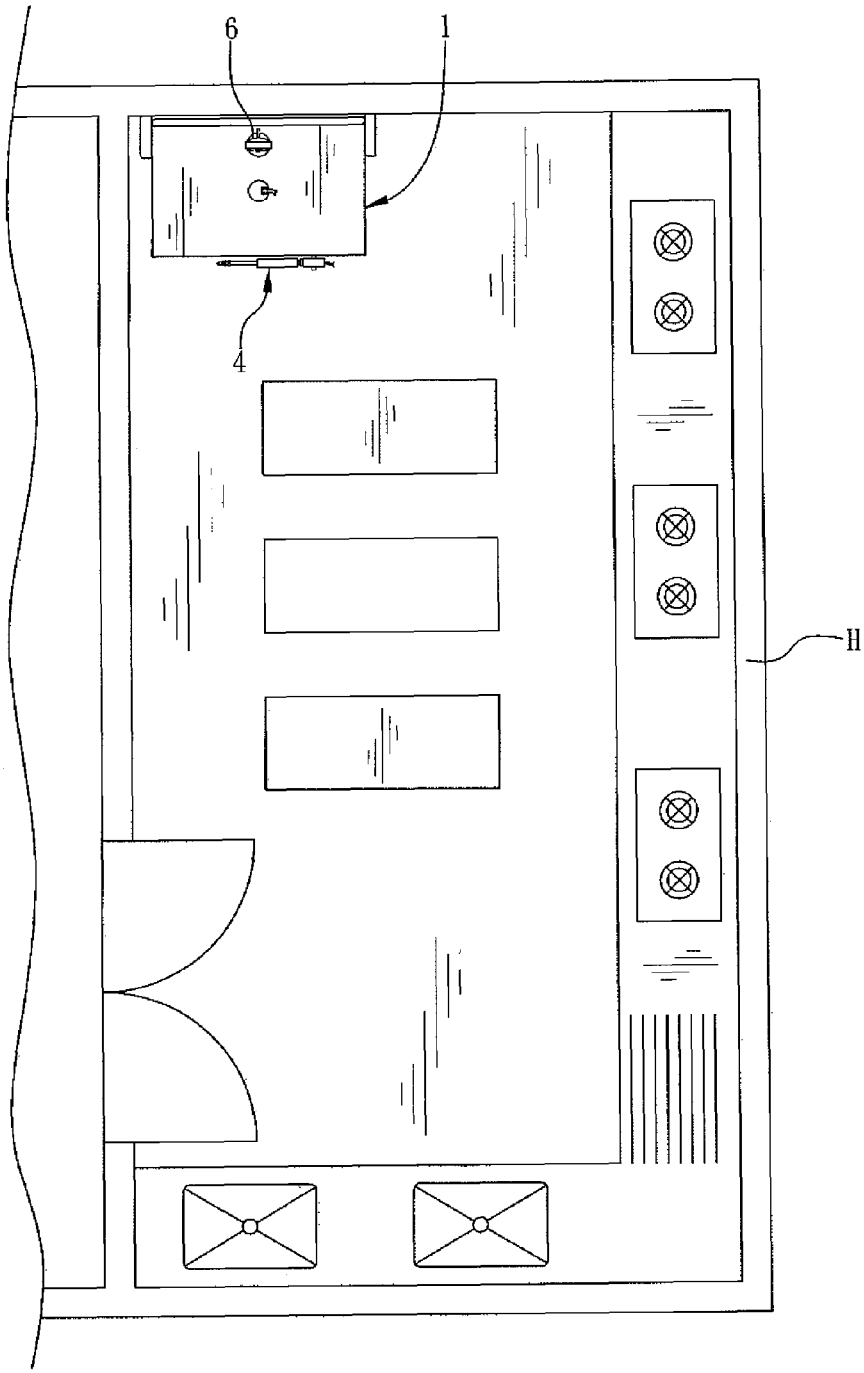
FIG. 6 is a top view of the fire apparatus for a house kitchen in accordance with the preferred embodiment of the present invention.

As shown in FIG. 6, the housing 1 is placed on a corner of a house kitchen "H".

Accordingly, the spray gun 4 injects atomized water outward so as to extinguish the fires easily and quickly. In addition, the microswitch 51 of the support unit 5 can control operation of the drive motor 11 to release the pressure in the hose 33 after the fires are extinguished so as to prevent the hose 33 from leaking due to an excessive pressure. Further, the spray gun 4 is movable to extinguish the fires at the determined location "F" without wetting the other place in the house so as to prevent from causing damage to the electric appliances in the house. Further, the electric storage unit 12 is used to supply the electric power so that the spray gun 4 can be operated normally when the external power supply fails. Further, the illuminating unit 6 is rotatable freely so as to provide an illuminating effect to the user. Further, the water tank 2 is externally connected with an independent water source "W" to supply water to the spray gun 4 so that the spray gun 4 can inject atomized water successively.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A fire apparatus comprising:

a housing;

a water tank mounted in the housing;

a support unit mounted on the housing;

a spray gun mounted on and supported by the support unit;

a hose having a first end connected with the water tank and a second end connected with the spray gun;

a drive motor mounted in the housing and connected with the spray;

an electric storage unit mounted in the housing and electrically connected with the drive motor to supply an electric power to the drive motor, said drive motor energized by the supplied electrical power to deliver pressured water to exit from the spray gun; and a microswitch electrically connected with the drive motor for controlling operations of the drive motor, said microswitch being disposed on the support unit, said the spray gun pressing the microswitch of the support unit at a normal state for the drive motor to stop operating at the normal state.

2. The fire apparatus of claim 1, wherein the spray gun is provided with a trigger and a spraying nozzle.

3. The fire apparatus of claim 1, wherein the fire apparatus further comprises an illuminating unit mounted on the housing and electrically connected with the electric storage unit.

4. The fire apparatus of claim 3, wherein the illuminating unit is mounted on the top of the housing and is located outside of the housing.

5. The fire apparatus of claim 4, wherein the illuminating unit is rotatable through three hundred and sixty degrees (360 degree.).

6. The fire apparatus of claim 1, wherein the fire apparatus further comprising a bubble tank mounted in the housing having connection with the first end of the hose.

7. The fire apparatus of claim 6, wherein the bubble tank includes a connection with the drive motor for pressurizing the bubble tank and the hose.

8. The fire apparatus of claim 1, wherein the support unit is located outside of the housing.

9. The fire apparatus of claim 1, wherein the spray gun is removably mounted on the support unit.

10. The fire apparatus of claim 1, wherein the spray gun is detachable from the microswitch of the support unit when the spray gun is removable from the support unit so that the microswitch of the support unit is released to conduct and start the drive motor which delivers the water in the water tank through the hose into the spray gun and pressurizes the water in the spray gun to form a high pressure water.

11. The fire apparatus of claim 1, wherein when the spray gun presses the microswitch of the support unit, the drive motor stops operating and releases the pressure in the hose.

12. The fire apparatus of claim 1, wherein the hose is mounted in the housing and is extendable outward from the housing.

13. The fire apparatus of claim 1, wherein the electric storage unit is a direct-current secondary battery.

14. The fire apparatus of claim 1, wherein the water tank is externally connected with an independent water source that is located outside of the housing.

15. The fire apparatus of claim 1, wherein the fire apparatus further comprises an independent power supply electrically connected with the electric storage unit to charge the electric storage unit.

16. The fire apparatus of claim 1, wherein the fire apparatus further comprises: a substantially inverted U-shaped support rail mounted on a top of the housing; a plurality of castors mounted on a bottom of the housing.

17. The fire apparatus of claim 1, wherein the drive motor is connected with the water tank to pressurize the water tank and the hose and to deliver the water in the water tank through the hose into the spray gun.

* * * * *